US010639225B1

(12) United States Patent
Gollands

(10) Patent No.: US 10,639,225 B1
(45) Date of Patent: May 5, 2020

(54) INDEPENDENCE RISERS STAIR CUBE

(71) Applicant: Lynne R. Gollands, Chelmsford, MA (US)

(72) Inventor: Lynne R. Gollands, Chelmsford, MA (US)

( * ) Notice: Subject to any disclaimer, the term of this patent is extended or adjusted under 35 U.S.C. 154(b) by 0 days.

(21) Appl. No.: 16/692,505

(22) Filed: Nov. 22, 2019

(51) Int. Cl.
*A61H 3/00* (2006.01)

(52) U.S. Cl.
CPC ..... *A61H 3/00* (2013.01); *A61H 2003/001* (2013.01); *A61H 2201/0157* (2013.01); *A61H 2201/0173* (2013.01)

(58) Field of Classification Search
CPC ..... A61H 2003/001; A61H 2202/157; A61H 2201/0173
See application file for complete search history.

(56) References Cited

U.S. PATENT DOCUMENTS 2,206,862 A * 7/1940 Boyd ..... E04F 11/16 52/182
2,782,796 A * 2/1957 Blue ..... A61H 3/02 135/65
3,884,327 A * 5/1975 Zigman ..... E06C 1/39 182/113
4,113,161 A * 9/1978 Manuszak ..... A45C 13/26 108/14
4,258,735 A * 3/1981 Meade ..... A45B 3/00 135/65
D287,283 S * 12/1986 Johnson ..... E04F 11/0201 182/228.1
4,844,199 A * 7/1989 Nimz ..... A61H 3/00 182/106
5,131,494 A * 7/1992 Heifetz ..... A61H 3/00 182/106
5,318,057 A * 6/1994 Wallum ..... A61H 3/02 135/65
5,355,904 A * 10/1994 Wallum ..... A61H 3/00 135/65
5,664,379 A * 9/1997 Kroll ..... E04F 11/02 52/183
5,941,262 A * 8/1999 Tschirhart ..... A61H 3/00 135/65
7,686,138 B2 * 3/2010 Schmidt ..... A61H 3/00 187/201
2003/0111100 A1 * 6/2003 Bell ..... A61H 1/00 135/67
2016/0346157 A1 * 12/2016 Barto ..... A61H 3/00

* cited by examiner

*Primary Examiner* — Noah Chandler Hawk
(74) *Attorney, Agent, or Firm* — Elmore Patent Law Group, P.C.; Carolyn Elmore

(57) ABSTRACT

The Independence Risers Stair Cube provides a safe, lightweight level surface that can be placed and moved by a caregiver or physical therapist for training that will allow a person using a walker to negotiate stairs both inside and outside of the home. The invention provides for the cube and methods of use.

12 Claims, 2 Drawing Sheets

INDEPENDENCE RISERS STAIR CUBE

BACKGROUND OF THE INVENTION

The ability to ascend and descend stairs can be precluded for individuals who must maintain a non-weight bearing status due to surgery or injury. For many, axillary crutch use requires significant energy expenditure and dynamic balance that can affect overall walking safety. For these individuals, a walker and wheelchair are usually prescribed for the 1-3 months of non-weight bearing status. Even for an individual who can effectively ambulate with crutches on level surfaces, negotiation of stairs can be difficult and unsafe.

Current options have required installation of a temporary ramp or, if the person has adequate upper body strength, bumping up and down the stairs in sitting. Egress from the home has been precluded and, for many, the ability to access their bedroom and only full bathroom on a $2^{nd}$ floor has been made impossible. In these instances, individuals have been homebound and must sleep on the $1^{st}$ floor with sink sponge bathing for hygiene. In some cases, it has required the individual to take an ambulance or car van to mandatory medical/orthopedic appointments.

Standard walkers require a substantially level surface. However, stairs typically have a run or tread depth which is less than the depth of a walker frame. Several devices have been suggested to allow the use of a walker on stairs. Patents to walkers with telescoping or adjustable legs, for example, have been suggested. However, the industry requires a device that is easy to use and inexpensive to manufacture.

SUMMARY

The Independence Risers Stair Cube will provide a safe, lightweight level surface that can be placed and moved by a caregiver or physical therapist for training that will allow a person using a walker to negotiate stairs both inside and outside of the home. It will provide hospital, rehab facilities, and out-patient settings an educational device that health care professionals can utilize for instruction and can be expanded for use at home. Because of its portability, it can be put in the back of a car and an individual can access additional locations during their course of healing. On the retail market, with adequate instructions and diagrams, the invention will afford improved independence for anyone limited by stairs. This technique could be beneficial for a proficient axillary crutch user and would allow for more surface area for their optimal gait pattern.

The invention includes methods of ascending and descending stairs with the cube, method comprising 1) placing the cube against, or abutting, a step to create an extended step; 2) ascending or descending onto the extended step while supported by a walker or crutches; and 3) moving the Cube up or down to extend subsequent steps until the person has completed negotiation of the stairs.

BRIEF DESCRIPTION OF THE FIGURES

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Use of the Cube to navigate interior stairs or to egress the home will require the assistance of one person to move and place the cube down or up to allow placement of the front walker legs or wheels. With this method, the individual will have a stable platform that is 2 stairs deep for placement of the walker and to allow them to step down or up each stair riser onto a level platform. The individual will descend stairs facing forward. To ascend stairs, the individual will perform each step backwards. This allows for optimal use of upper body strength. Ergonomically, it is difficult to be non-weight bearing on a limb and ascend stairs forward with a walker. It would be possible for someone who is on crutches to use the cube to allow for a deeper swing step up to the next stair tread.

For safe ascending of stairs with a walker and the cube, the individual can have functional upper body strength to off-load their weight onto the walker. Placement of the cube during negotiation of stairs will typically use the assistance of another person, yet this would not preclude someone from living alone.

For those who cannot weight-bear completely on a lower limb due to weakness or pain, the Cube can also provide improved accessibility with a walker on stairs in the presence of adequate upper body and uninvolved lower limb strength as well as functional dynamic balance.

Figure 1:
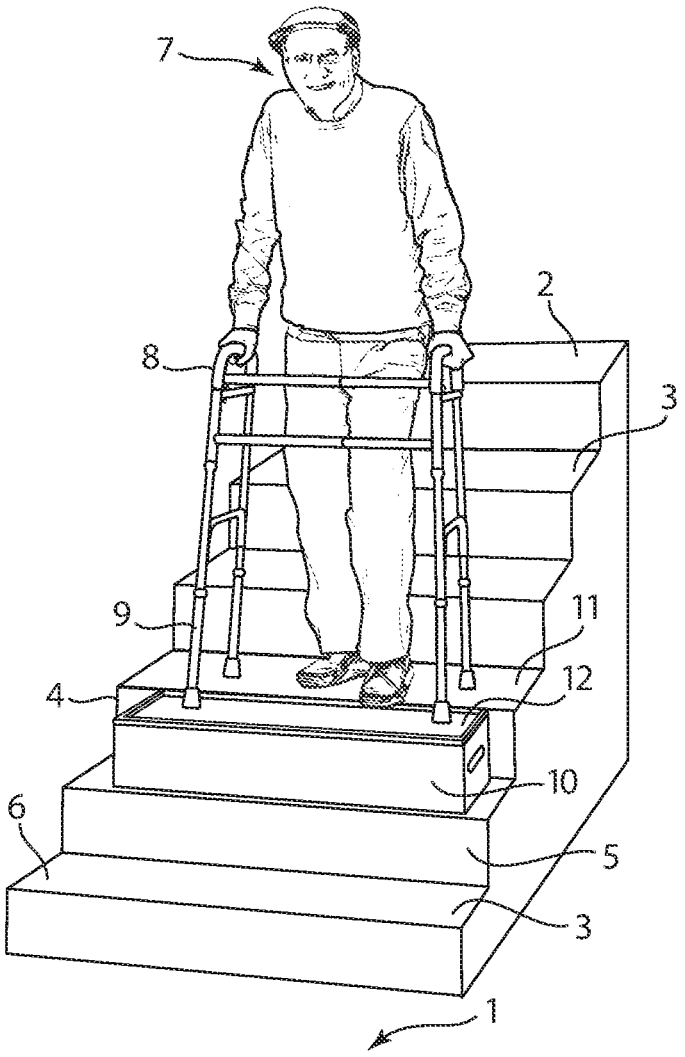
FIG. 1 illustrates an individual negotiating stairs with the assistance of a Cube.

Stairs are typically characterized by a bottom landing and a top landing and one or more steps immediately disposed above the bottom landing and/or below the top landing. A stair can be characterized by a single step disposed between two landings or a plurality of steps. FIG. 1 illustrates a typical multi-step stair with a bottom landing 1, a top landing 2, a first step 3 disposed immediately above and/or below a landing, and additional steps 4. Steps are characterized by a rise 5 (the height or vertical dimension of the step) and a run 6 (the depth of a tread). The person 7 is shown with a walker 8 characterized by four legs 9, two of which rest upon a Cube 10 of the invention which, together with an abutting step 11 forms an extended step 12.

Typically, the invention provides a method for assisting a person to ascend stairs comprising the steps of:

a. causing the person to approach the stairs backwards while supported by a walker resting on the bottom landing;
b. causing the person to ascend backwards onto a first step while supported by the walker;
c. lifting the walker;
d. placing a cube on the bottom landing abutting the first step to create an extended step;
e. lowering the walker onto the extended step;
f. while supported by the walker, causing the person to ascend backwards onto an additional step or top landing immediately disposed above the first step;
g. optionally lifting the walker; moving the cube to the additional step to create an additional extended step; lifting the walker to the additional extended step; and causing the person to ascend backwards onto the additional step;
h. optionally repeating step (g) one or more times until the person reaches the top landing;

i. lifting the walker and lowering the walker on the top landing;

wherein the cube is characterized by a height substantially equivalent to a rise of the step; a depth substantially equivalent to a run of the step; and a width that is between a width of the walker and a width of the step.

The invention also provides a method for assisting a person to descend stairs comprising the steps of:

a. placing a cube on an additional step abutting the first step to create an extended step;

b. while the person is located on the top landing facing the stairs, lowering a walker on the extended step;

c. causing the person to descend onto the extended first step while supported by the walker;

d. optionally lifting the walker; moving the cube to a step disposed immediately below the extended step to create a subsequent extended step; lowering the walker on the subsequent extended step; and causing the person to descend onto the subsequent extended step;

e. optionally repeating step (d) one or more times until the person reaches a bottom landing;

f. lifting the walker; removing the cube; lowering the walker onto the bottom landing and causing the person to descend onto the bottom landing;

wherein the cube is characterized by a height substantially equivalent to a rise of the step; a depth substantially equivalent to a run of the step; and a width that is between a width of the walker and a width of the step.

Additionally, because stairs may be characterized by a single step, the invention provides for a method for assisting a person descend stairs comprising the steps of:

a. placing a cube on the bottom landing abutting the first step to create an extended step;

b. while the person is located on the top landing facing the stairs, lowering a walker on the extended step;

c. causing the person to descend onto the extended first step while supported by the walker;

d. lifting the walker; removing the cube; lowering the walker onto the bottom landing and causing the person to descend onto the bottom landing;

wherein the cube is characterized by a height substantially equivalent to a rise of the step; a depth substantially equivalent to a run of the step; and a width that is between a width of the walker and a width of the step.

The term "causing" is used herein to include instructing (such as by verbal or written commands), guiding (such as by providing physical direction or support) or simply supervising a person for safety.

The term "backwards" means with approaching the stairs with the person facing the opposite direction with their back approaching the stair firstly. An ascending person is moving backwards relatively to a stair if the front of their body is facing the lower or bottom landing.

The term "walker" means a device characterized by a frame and a plurality of legs that provides an individual with support for walking. The frame typically envelopes the person on three sides (front and sides) and is open in the rear allowing the individual to approach. The person typically receives support by gripping the sides of the frame, pushing the frame in the direction they wish to travel as they travel. In the context of navigating stairs, the walker will typically be lifted and lowered from one step to another. It is specifically intended that the cube can also be used to assist an individual on crutches, cane and other devices as well. Thus, the term "walker" can be substituted by the terms "crutch" and "cane" in each instance as if reproduced here.

The term "supported by," particularly when used in context of a walker, means the person is gripping the walker and placing some or all of their weight onto the walker.

The cube is moved from one step to another (or to a landing). The cube is typically moved by another individual, such as a caregiver or physical therapist attending to the person. When the cube is moved, it is typically placed flat on the tread of a step (or landing) abutting the rise of a step.

The cube will typically be fabricated from a material that can support a weight of 100 kg or more, preferably at least 150 kg (approximately 300 lbs). It can preferably be made from a high density, light weight plastic, such as polypropylene. However, other materials can be used as well, such as wood, steel and the like. Reinforcement can be provided in the interior for additional support and to limit flexing along the surfaces.

Figure 2:
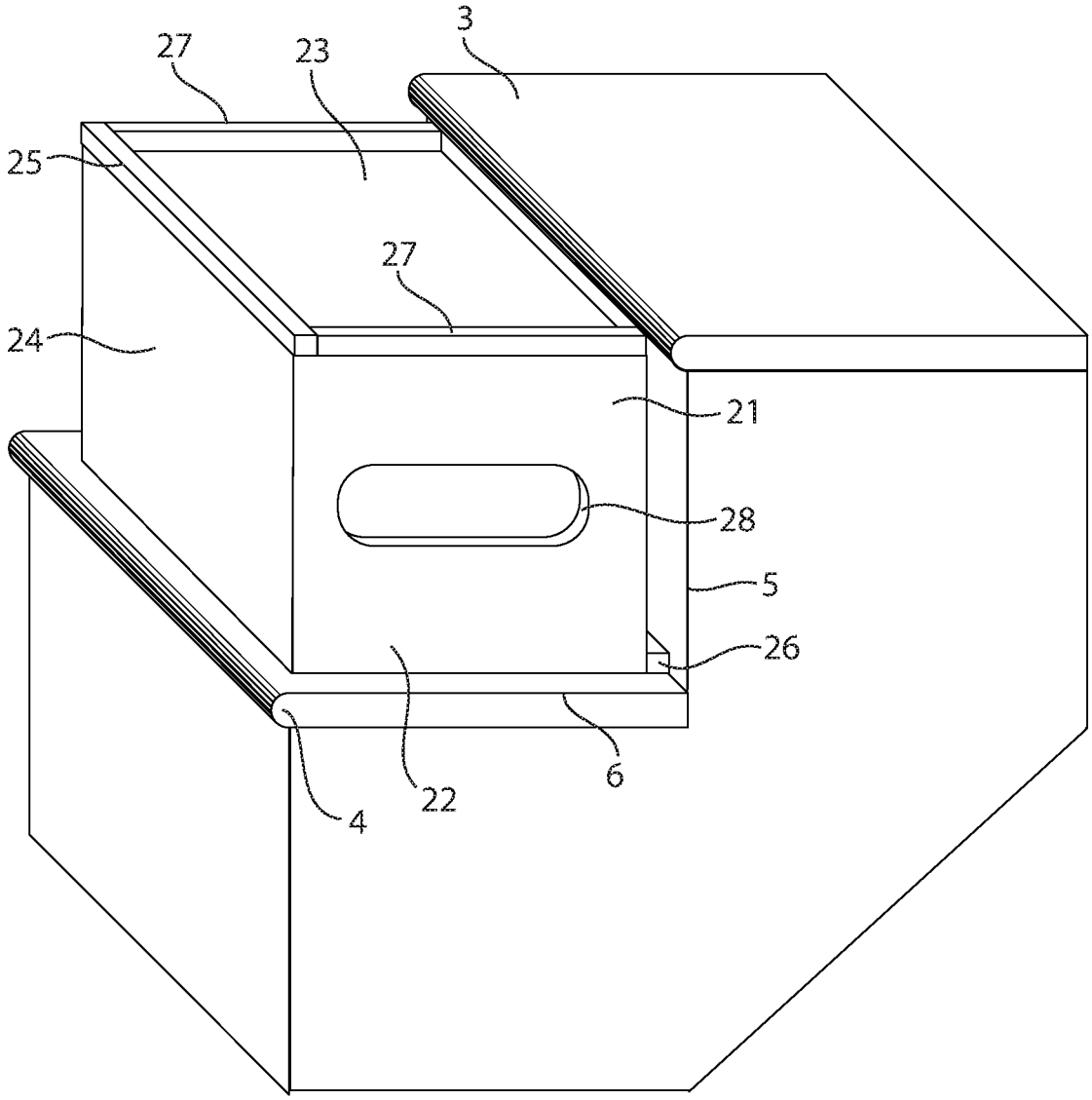
FIG. 2 illustrates an embodiment of a Cube of the invention.

Referring to FIG. 2, the cube 21 is typically characterized by 6 sides adjoining at 90° angles. The ends 22 of the cube are approximately square and the first length 23 and second length 24 are rectangular. The ends and lengths opposing those displayed are essentially the same. Dimensions of the Cube allow for essentially level height for step rise and tread run/depth that accommodate the front of a walker. The prototype is about 18 cm (7.25") by about 20 cm (8"). These dimensions were selected because a typical interior step has a rise about 18 cm (7.25") high while a typical exterior step has a rise about 20 cm (8") high. Even if the Cube is slightly lower or higher than the step, the platform is stable and safe to accommodate the person. These dimensions also conveniently provide a Cube with a tread run approximately the same as the step run/depth, which is often about 25 cm (10"). It is specifically intended for the term "substantially equivalent to a run of a step" to embrace the range from about 15 cm and 30 cm, preferably 20 cm.

The recommended optimal width will provide support for the entire walker and the individual. For example, the width of the Cube can be between about 70 cm and 100 cm. The prototype was fabricated at a width of about 70 cm (28"). When fabricated at about 80 cm (32"), the Cube would allow a proficient axillary crutch or walker user additional sure area for safe navigation of the stairs.

In order to accommodate Bariatric Rolling Walkers which have 2 front wheels on each side, the Cube can be between 32"-34" wide. The walker depth with wheels is 19" and the width is 29"-30". Stair treads for the Cube used in this instance would need to be 9"-10" in depth for safe negotiation.

The Cube can preferably be characterized by a lip or protrusion 25 along one or more lengths, or leading edge. The lip or protrusion can be about 1 cm×1 cm (½"×½"). The Cube can then be placed abutting the step rise such that the protrusion 25 is on the top, exposed surface, distal to the rise. This placement will provide a stop for the walker to prevent accidental slippage and a fall. Because the Cube can be made to accommodate heights for two differing step rises, a second protrusion 26 can be engineered onto an adjoining length such that a stop will be provided for both surfaces. It will be advantageous when placing such a Cube on a step to ensure that a flat surface is resting upon the tread and the second protrusion 26 is lying against and parallel to the tread as shown. Additional protrusions can be incorporated along the width edge to prevent a stop and slide slippage of a walker.

It will, therefore, be clear that the term "cube" is defined herein to include an asymmetrical three-dimensional shape generally having six rectangular sides joined together at approximately 90 degree angles, such as is typical of a rectangular prism.

On one or both ends 22 there can be a handle, such as a recess, build out, or cutaway, for easy carrying.

The surfaces of the cube can be equipped with a non-skid surface. For example, the surface can have a rubber layer or a roughed surface to increase friction between the cube and the stair treads and/or walker. On the opposite side, there will be a washable, non-skid surface (the Prototype has rubber rug underlay affixed to it).

The terms "about" or "comprising essentially of" refer to a value or composition that is within an acceptable error range for the particular value or composition as determined by one of ordinary skill in the art, which will depend in part on how the value or composition is measured or determined, i.e., the limitations of the measurement system. For example, "about" can mean within 1 or more than 1 standard deviation per the practice in the art. Alternatively, "about" or "comprising essentially of" can mean a range of up to 20%. Furthermore, particularly with respect to biological systems or processes, the terms can mean up to an order of magnitude or up to 5-fold of a value. When particular values or compositions are provided in the application and claims, unless otherwise stated, the meaning of "about" or "comprising essentially of" should be assumed to be within an acceptable error range for that particular value or composition.

As described herein, any concentration range, percentage range, ratio range or integer range is to be understood to include the value of any integer within the recited range and, when appropriate, fractions thereof (such as one tenth and one hundredth of an integer), unless otherwise indicated.

The patent and scientific literature referred to herein establishes the knowledge that is available to those with skill in the art. All United States patents and published or unpublished United States patent applications cited herein are incorporated by reference. All published foreign patents and patent applications cited herein are hereby incorporated by reference. All other published references, documents, manuscripts and scientific literature cited herein are hereby incorporated by reference.

While this invention has been particularly shown and described with references to preferred embodiments thereof, it will be understood by those skilled in the art that various changes in form and details may be made therein without departing from the scope of the invention encompassed by the appended claims. It should also be understood that the embodiments described herein are not mutually exclusive and that features from the various embodiments may be combined in whole or in part in accordance with the invention.

What is claimed is:

1. A method for assisting a person to ascend stairs, wherein the stairs comprise a bottom landing, one or more steps immediately disposed above the bottom landing, and a top landing, the method comprising;

a. causing the person to approach the stairs backwards while supported by a walker resting on the bottom landing;

b. causing the person to ascend backwards onto a first step while supported by the walker;

c. lifting the walker;

d. placing a cube on the bottom landing abutting the first step to create an extended step;

e. lowering the walker onto the extended step;

f. while supported by the walker, causing the person to ascend backwards onto an additional step or top landing immediately disposed above the first step;

g. optionally lifting the walker; moving the cube to the additional step to create an additional extended step; lifting the walker to the additional extended step; and causing the person to ascend backwards onto the additional step;

h. optionally repeating step (g) one or more times until the person reaches the top landing;

i. lifting the walker and lowering the walker on the top landing;

wherein the cube is characterized by a height substantially equivalent to a rise of the step; a depth substantially equivalent to a run of the step; and a width that is between a width of the walker and a width of the step.

2. The method of claim 1, wherein the cube can support a load of 100 kg or more.

3. The method of claim 1, wherein the cube is characterized by a height of about 18 cm, a depth of about 20 cm.

4. The method of claim 1, wherein the cube has a length of about 70 cm.

5. The method of claim 1, wherein the cube is further characterized by a protrusion along its top length distal from a step rise when abutting a step configured to provide a stop for the walker.

6. The method of claim 1, wherein the cube is characterized by a first protrusion along its top length distal from a step rise when abutting a step configured to provide a stop for the walker and a second protrusion along a second length abutting and parallel to a run of a step.

7. The method of claim 1, wherein two adjoining surfaces of the cube are characterized by protrusions along the surface's perimeters to provide stops for the walker.

8. The method of claim 1, wherein the cube is characterized by one or more handles.

9. The method of claim 1, wherein the cube is characterized by two or more handles recessed into opposing sides.

10. The method of claim 1, wherein the cube is characterized by non-skid surfaces.

11. A method for assisting a person to descend stairs, wherein the stairs comprise a top landing, a first step disposed immediately below the top landing, one or more additional steps disposed immediately below the first step and a bottom landing, the method comprising;

a. placing a cube on an additional step abutting the first step to create an extended step;

b. while the person is located on the top landing facing the stairs, lowering a walker on the extended step;

c. causing the person to descend onto the extended first step while supported by the walker;

d. optionally lifting the walker; moving the cube to a step disposed immediately below the extended step to create a subsequent extended step; lowering the walker on the subsequent extended step; and causing the person to descend onto the subsequent extended step;

e. optionally repeating step (d) one or more times until the person reaches a bottom landing;

f. lifting the walker; removing the cube; lowering the walker onto the bottom landing and causing the person to descend onto the bottom landing;

wherein the cube is characterized by a height substantially equivalent to a rise of the step; a depth substantially equivalent to a run of the step; and a width that is between a width of the walker and a width of the step.

12. A method for assisting a person descend stairs, wherein the stairs comprise a top landing, a first step disposed immediately below the top landing, and a bottom landing, the method comprising;

a. placing a cube on the bottom landing abutting the first step to create an extended step;

b. while the person is located on the top landing facing the stairs, lowering a walker on the extended step;

c. causing the person to descend onto the extended first step while supported by the walker;

d. lifting the walker; removing the cube; lowering the walker onto the bottom landing and causing the person to descend onto the bottom landing;

wherein the cube is characterized by a height substantially equivalent to a rise of the step; a depth substantially equivalent to a run of the step; and a width that is between a width of the walker and a width of the step.

* * * * *